US007930971B2

(12) United States Patent
Werkhoven

(10) Patent No.: US 7,930,971 B2
(45) Date of Patent: Apr. 26, 2011

(54) ROTARY ACTUATOR WITH INTERNAL BRAKE MECHANISM

(76) Inventor: Gary L. Werkhoven, Duluth, MN (US)

( * ) Notice: Subject to any disclaimer, the term of this patent is extended or adjusted under 35 U.S.C. 154(b) by 464 days.

(21) Appl. No.: 12/210,610

(22) Filed: Sep. 15, 2008

(65) Prior Publication Data

US 2010/0064885 A1 Mar. 18, 2010

(51) Int. Cl.
*F01C 9/00* (2006.01)
*F15B 15/26* (2006.01)

(52) U.S. Cl. ..... 92/121; 92/26; 92/27

(58) Field of Classification Search ..... 92/15, 26, 92/27, 28, 120, 121, 125
See application file for complete search history.

(56) References Cited

U.S. PATENT DOCUMENTS

| | | | | |
|---|---|---|---|---|
| 2,489,326 | A | | 11/1949 | Rockstrom et al. |
| 2,564,206 | A | * | 8/1951 | Johnson ..... 92/121 |
| 2,975,766 | A | | 3/1961 | Henry |
| 3,017,807 | A | | 1/1962 | Grover |
| 3,179,018 | A | | 4/1965 | Rumsey |
| 3,179,020 | A | | 4/1965 | Rumsey |
| 3,195,421 | A | | 7/1965 | Rumsey et al. |
| 3,198,090 | A | | 8/1965 | French |
| 3,225,664 | A | | 12/1965 | Rumsey |
| 3,269,737 | A | | 8/1966 | Freese |
| 3,359,871 | A | | 12/1967 | Kamman |
| 3,379,100 | A | | 4/1968 | Rumsey et al. |
| 3,426,654 | A | | 2/1969 | Laughman |
| 3,470,793 | A | | 10/1969 | Hanchen |
| 3,521,527 | A | | 7/1970 | Gies et al. |
| 3,586,137 | A | | 6/1971 | Kamman |
| 3,968,731 | A | | 7/1976 | Myers |
| 4,009,639 | A | | 3/1977 | Sabashi |
| 5,101,862 | A | | 4/1992 | Leete |
| 5,383,758 | A | | 1/1995 | Patrick |
| 5,447,095 | A | | 9/1995 | Weyer |
| 5,467,596 | A | | 11/1995 | Yu |
| 5,996,523 | A | | 12/1999 | Fox |
| 6,322,341 | B1 | | 11/2001 | Haas |

OTHER PUBLICATIONS

Helac Corporation, Helical, Hydraulic Rotary Actuators, L10 Series, 2005.
Helac Corporation, Helical, Hydraulic Rotary Actuators, L20 Series, 2005.
Helac Corporation, Helical, Hydraulic Rotary Actuators, L30 Series, 2005.

* cited by examiner

*Primary Examiner* — Michael Leslie
(74) *Attorney, Agent, or Firm* — Thomas J. Nikolai; Nikolai & Mersereau, P.A.

(57) ABSTRACT

A vane type hydraulic rotary actuator incorporates a fail-safe brake for preventing movement of the device's rotor relative to a housing in which the rotor is journaled. The brake has a spring-biased piston that is forced to a locked condition whenever applied hydraulic operating pressure acting on the vane falls below a predefined limit. The rotary actuator also incorporates an improved sealing arrangement that prevents egress of hydraulic fluid from a high pressure chamber on one side of the vane to a low pressure chamber on the opposite side of the vane.

7 Claims, 6 Drawing Sheets

ROTARY ACTUATOR WITH INTERNAL BRAKE MECHANISM

BACKGROUND OF THE INVENTION

I. Field of the Invention

The present invention relates generally to a hydraulic rotary actuator of the vane type, and more particularly to such a rotary actuator having improved seal structures and a fail-safe brake mechanism.

II. Discussion of the Prior Art

Hydraulic rotary actuators find application in a number of fields where it is desired to rotate a load through a predetermined angle relative to a stationary frame member. For example, a few applications use rotary actuators for controlling the positioning of a bucket on the end of a boom on a power company's utility truck, the rotation of the bucket on a backhoe and tipping refuse containers on refuse collection vehicles.

A typical vane-type hydraulic rotary actuator comprises a stator housing with a rotor journaled for rotation within the housing that defines an annular chamber between the rotor surface and the stator. Affixed to the rotor and cooperating with a cylindrical wall of the stator is a vane that divides the chamber into a pair of hydraulic fluid receiving chambers. Also disposed in the chamber and fixedly attached to the stator is a stop having opposed ends separated by a predetermined arc. Injection of high pressure hydraulic fluid into one of the pair of chambers forces the vane and, therefore, the rotor to shift through a predetermined angle until the vane strikes a first end of the stop. The movement of the vane also forces hydraulic fluid, now at a low pressure, out from the other of the two chambers. By reversing the chamber to which the high pressure hydraulic fluid is applied, the vane will now move in the opposite direction until reaching the other end of the stop. A typical prior art example of a vane type rotary actuator is disclosed in the French U.S. Pat. No. 3,198,090.

Also known in the art is the need for effective seals for preventing leakage of the high pressure hydraulic fluid past the vane which seriously detracts the efficiency of the hydraulic actuator and results in rotor drift. The sealing arrangements to date have an inherent leak path near the base of the vane where the shaft protrudes from the actuator. It is very difficult to prevent leakage across the vane and along the shaft (out of the actuator unit).

Furthermore, a need exists for an effective brake arrangement that will lock the rotor relative to the stator in the event of a loss of pressure, such as may result from a leak in a hydraulic line or the intended stoppage of the rotor with the vane part way between the opposed ends of the stop. Because seal leakage can result in unwarranted drifting of the load, it is known in the art to provide a brake arrangement or the incorporation of counterbalance valves. U.S. Pat. No. 3,179,018 to Rumsey describes a hydraulic rotary actuator that incorporates a hydraulic braking system for locking the rotor in any position throughout the operating range of the rotary actuator. By applying hydraulic fluid under pressure to a piston secured to the rotor, it is brought into contact with a brake shoe forming a part of the stator housing. The implementation disclosed in the '018 patent requires the application of hydraulic pressure to the brake assembly at all times, except when it is desired to reposition a load using the hydraulic actuator. Should the hydraulic brake line fail, the load would be free to swing which, of course, is highly undesirable and unsafe.

A need, therefore, exists for a vane-type hydraulic actuator having an internal brake that is fail safe, i.e., the brake force is applied to lock the rotor in the event that hydraulic pressure releasing the brake falls.

SUMMARY OF THE INVENTION

In accordance with the present invention, there is provided a rotary actuator comprising a housing defining a cylindrical bore in which a spool member is rotatably mounted. A vane is attached to the spool member and projects radially outward therefrom. Also mounted within the cylindrical bore and attached to the housing so as to project radially inward toward the spool member is a stop that has first and second end surfaces circumferentially spaced from one another and defining a gap through which the vane is free to move. The stop member includes first and second passageways for hydraulic fluid, each leading from an inlet port to an outlet port where the outlet ports are on respective ones of the first and second end surfaces.

The present invention utilizes continuous seals around the ends of the vane to prevent leakage across the vane and around the pool (shaft) to prevent external leakage. The slow rotational movement of this type of actuator allows for the vane seal to seal against the spool seal. Any inherent leak is thereby minimized.

The rotary actuator of the present invention further includes a hydraulically-actuated, spring-biased, friction brake mechanism that is operatively deployed between the housing and the spool member for preventing rotation of the spool member relative to the housing whenever hydraulic fluid pressure is being applied to an inlet port below a predetermined pressure value. More particularly, the brake mechanism includes a spring-biased piston that is adapted to cooperate with mating surfaces on the spool member to releasably lock the spool member to the housing and wherein the piston overcomes a force of at least one spring to release the lock when a predetermined hydraulic pressure is present in a space between one end surface of the stop member and the vane.

DESCRIPTION OF THE DRAWINGS

The foregoing features, objects and advantages of the invention will become apparent to those skilled in the art from the detailed description of a preferred embodiment, especially when considered in conjunction with the accompanying drawings in which like numerals in the several views refer to corresponding parts.

DESCRIPTION OF THE PREFERRED EMBODIMENT

Figure 1:
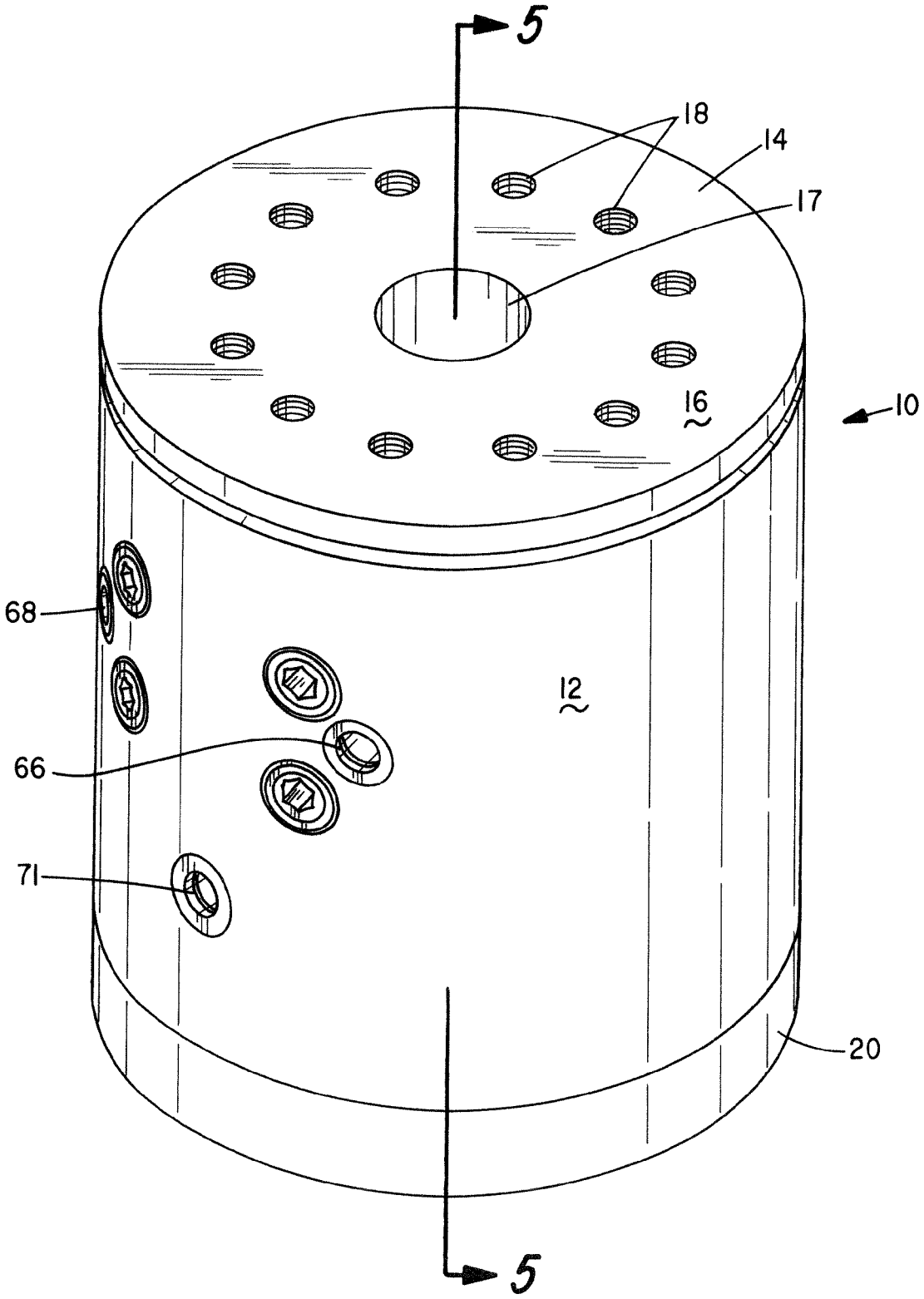
FIG. 1 is a perspective view of the rotary actuator assembly comprising a preferred embodiment of the present invention.

Referring first to FIG. 1, there is shown a perspective view of the rotary actuator assembly comprising a preferred embodiment of the present invention. It is indicated generally by numeral 10 and is seen to comprise a generally cylindrical housing 12 in which is journaled a spool member 14. That is to say, the spool member 14 is rotationally mounted within the housing 12, and visible on the upper surface 16 of the spool member is a central bore 17 and a plurality of threaded bores 18 arranged in a circular pattern by which the actuator assembly can be attached to one of a frame or load. The central bore 17 reduces the weight of the structure when foot mounted and also allows straddle mounting by inserting a support shaft through this bore. In the case of straddle mounting, the housing 12 is equipped with mounting feet (not shown) to secure it to a stationary member.

Bolted to the lower edge of the housing 12 is a cap member 20 and it, too, includes a pattern of threaded bolt holes allowing the rotary actuator assembly 10 to be attached to the other of the frame or load.

Figure 2:
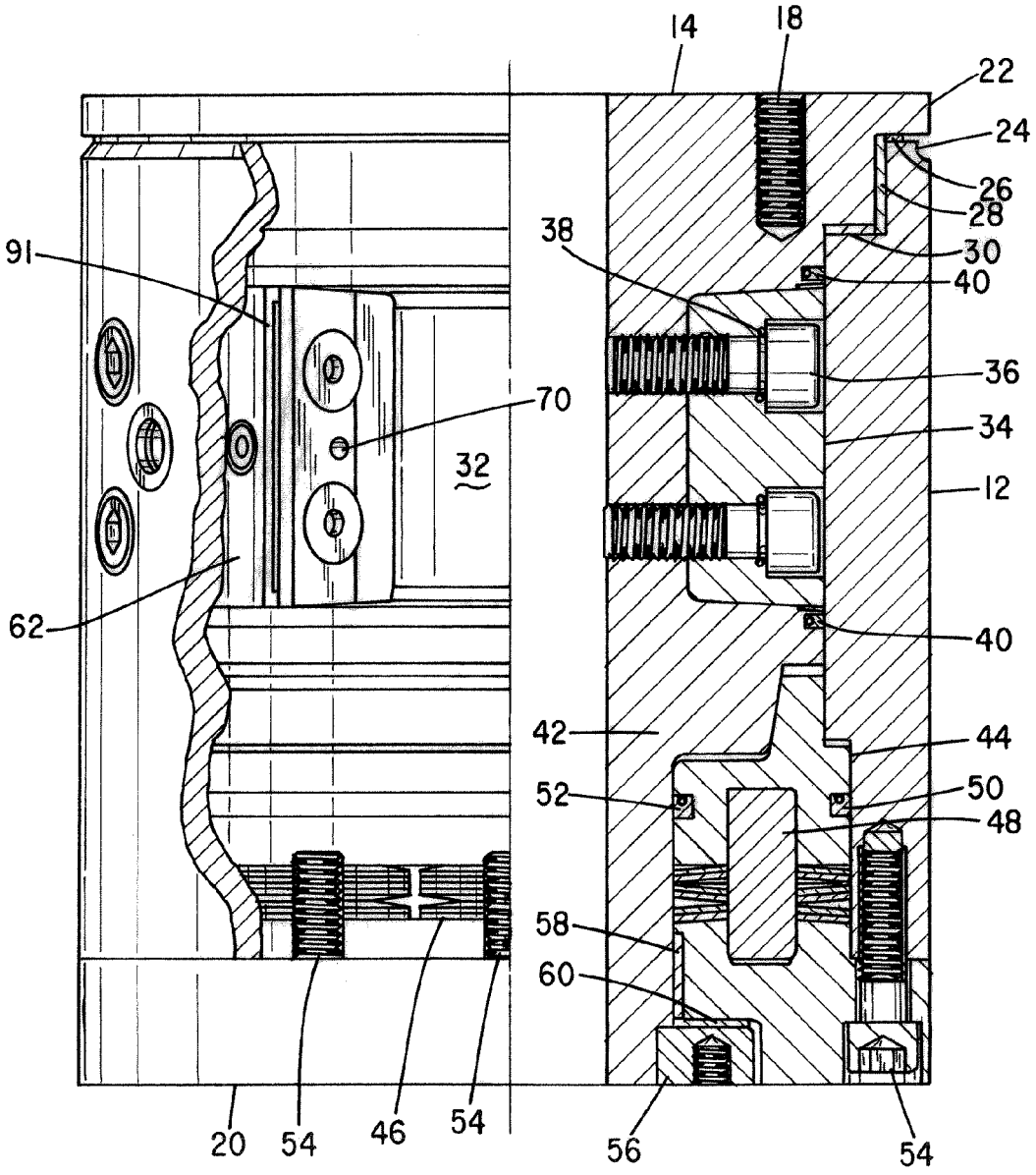
FIG. 2 is a view showing the rotary actuator partially sectioned and the housing broken away.

Referring next to FIG. 2, which shows the rotary actuator 10 partially sectioned and the housing broken away to reveal the inner construction of the assembly, it can be seen that the housing 12 has a stepped interior wall proximate its upper edge for rotationally supporting the spool member 14 thereon. Specifically, the perimeter edge 22 of the spool member overlays an upper edge 24 of the housing with a moisture seal 26 therebetween. A bushing 28 is inserted between mating surfaces of the housing and the spool member for centering the spool member within the confines of the housing. The spool member 14 rides upon a thrust bearing 30 that is disposed in a space between mating shoulders on the spool member 14 and the housing 12.

The spool member 14 includes an annular recess 32 and affixed to the wall of this recess by socket head cap screws 36 is a wedge-shaped vane 34. O-ring seals, as at 38, are provided between the heads of the cap screws and the vane to prevent leakage of hydraulic fluid along the length of the fastening bolts. Likewise, a seal and O-ring combination is disposed between the rotatable spool member 14 and the inner wall of the housing 12 adjacent the outer vertical edge of the vane 34, again to prevent hydraulic fluid under high pressure from escaping the confines of the spool recess 32 during operation of the hydraulic actuator 10.

With continued reference to FIG. 2, the spool member 14 has a frustoconical zone 42 for accommodating an internal brake piston 44 which rests upon one or more disk springs 46. Without limitation, the disk springs may be annular in shape and can be stacked on a series of circumferentially spaced dowel pins, as at 48, as will be explained in greater detail in connection with FIGS. 3 and 4. The annular brake member 44 has an outer annular groove about its perimeter and fitted into this groove is a cup seal 50. Likewise, an inner diameter of the annular brake 44 also has a seal groove occupied by a further cup seal 52.

The housing cap 20 is shown as bolted to the housing 12 by a series of circumferentially spaced socket head cap screws, several of which are identified in FIG. 2 by numeral 54. Formed inwardly from the bottom surface of the housing cap 20 is an annular, concentric recess into which is affixed an annular spool cap 56. By providing this spool cap, during assembly of the rotary actuator, a bushing 58 and a thrush washer 60 may be inserted prior to attachment of the spool cap 56 to facilitate centering of the spool member 14 and its ability to rotate within the housing.

Figure 3:
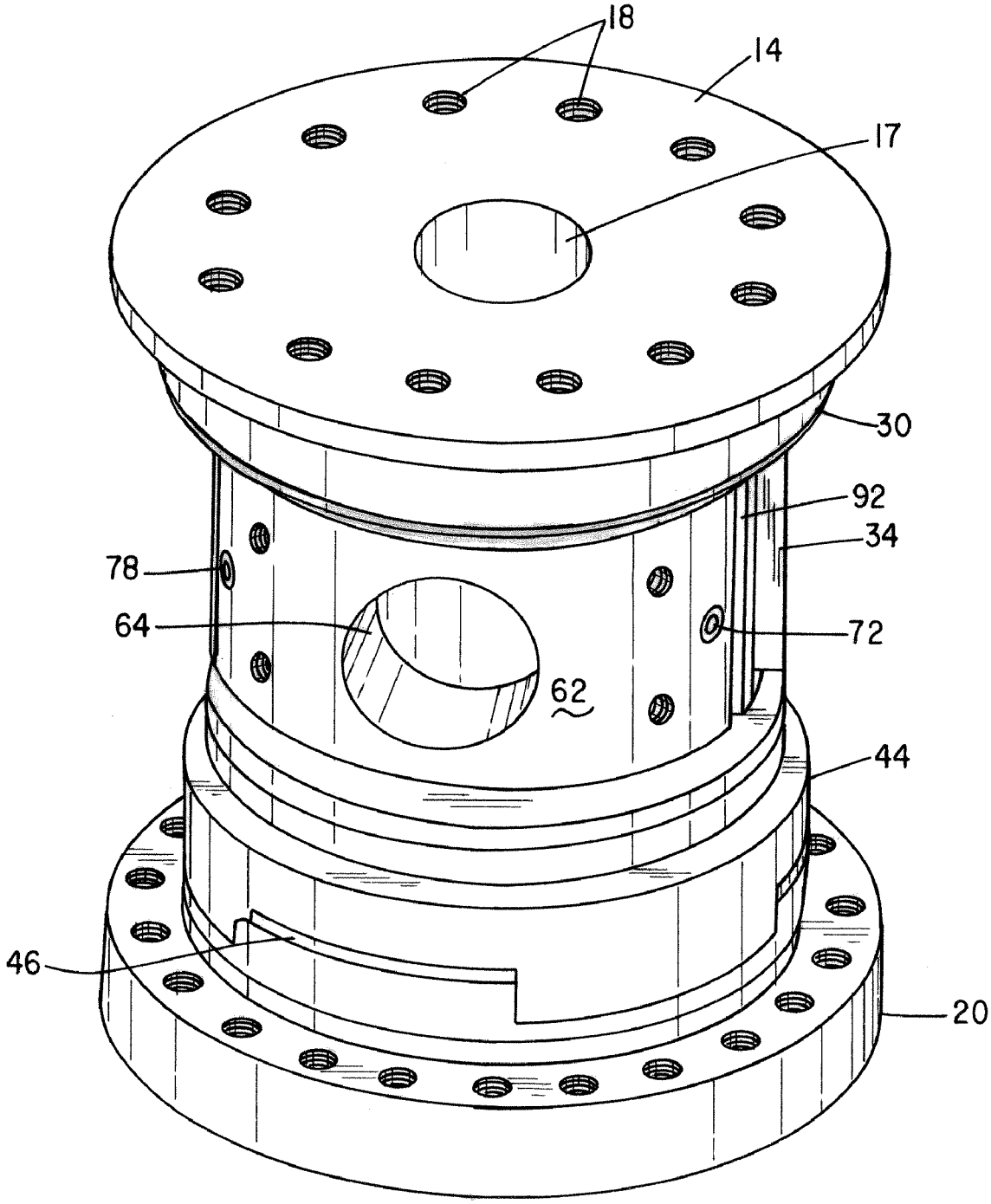
FIG. 3 is a view showing the rotary actuator assembly with the housing eliminated to reveal the inner working parts.

In the broken-away section shown in FIG. 2, there can be seen an arcuate stop 62. FIG. 3 illustrates the rotary actuator assembly with the housing 12 removed and, from this view, it can be seen that the stop 62 spans a predetermined arc. The arc of the stop 62 varies from model to model depending upon the desired angle of rotation; hence, any angle of rotation can be achieved up to 200°. The central opening 64 in the stop performs no function, except to reduce the overall weight of the device. Also visible in FIG. 3 are hydraulic fluid inlet/outlet ports 66 and 68 proximate the end faces of the stop 62. As explained in greater detail below, these inlet/outlet ports are connected by internal bores to ports, as at 70 in FIG. 2, formed on the exposed edge aces of the stop 62.

Figure 4:
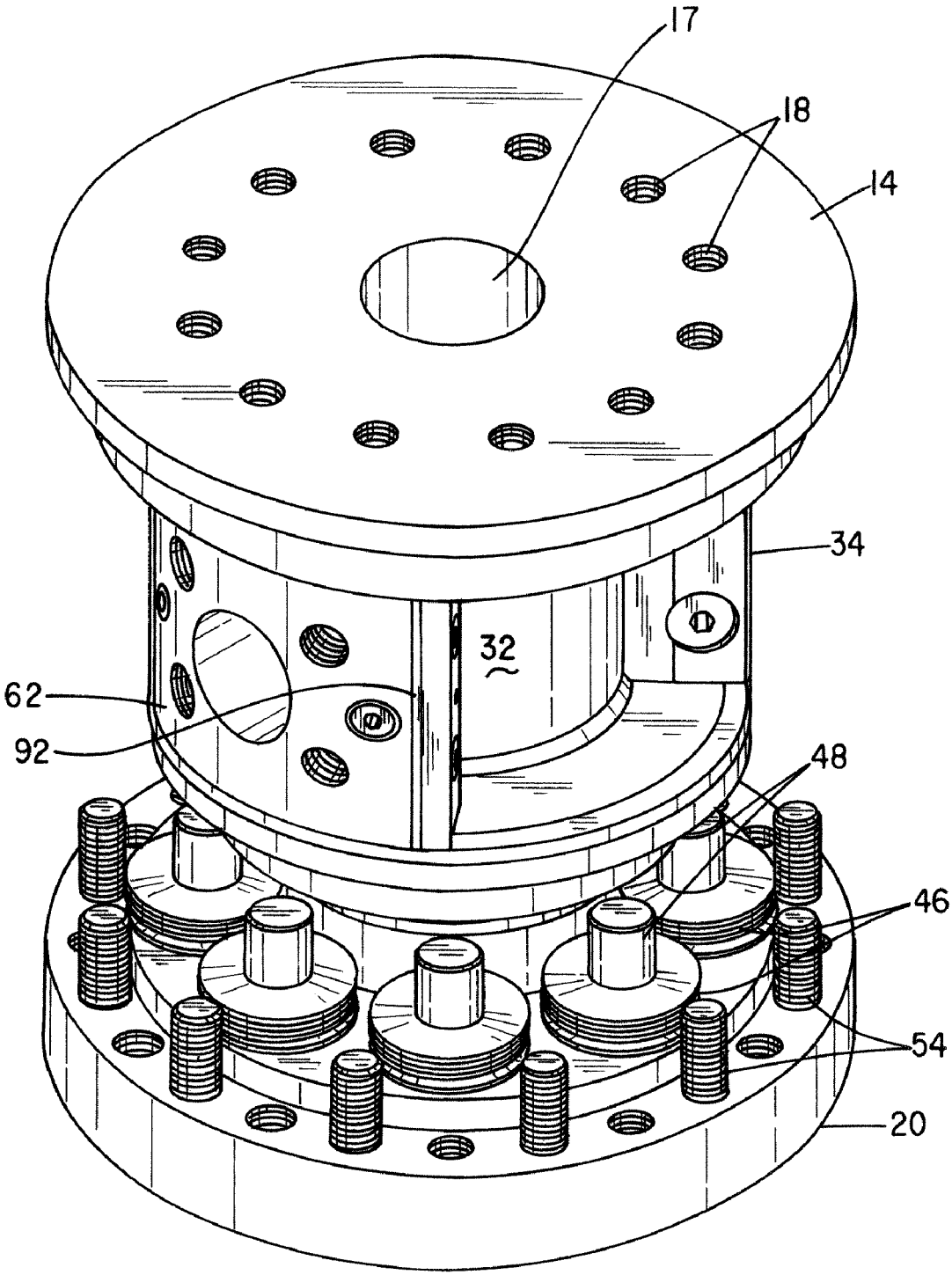
FIG. 4 is a view of the assembly with both the housing and the annular brake piston removed.

FIG. 4 is a view of the assembly with both the housing and the annular brake piston 44 removed to better illustrate one type of biasing spring arrangement that may be used in implementing the preferred embodiment. The stacks of Bellville springs are circumferentially equally spaced about the spool 14 on dowel pins 48 that project outward from bores formed on the upper face of housing cap 20. Other types of biasing springs, e.g., coil, wave compressible polymer, etc., may be used to supply force to engage the brake, but the Bellville type spring has been used in this illustration.

Also visible in FIG. 4 is the seal groove for the vane and stop seal 92. The seal has a rectangular shape and seals the end periphery of the vane and stop on each end. This prevents leakage across the vane cavity.

Figure 5:
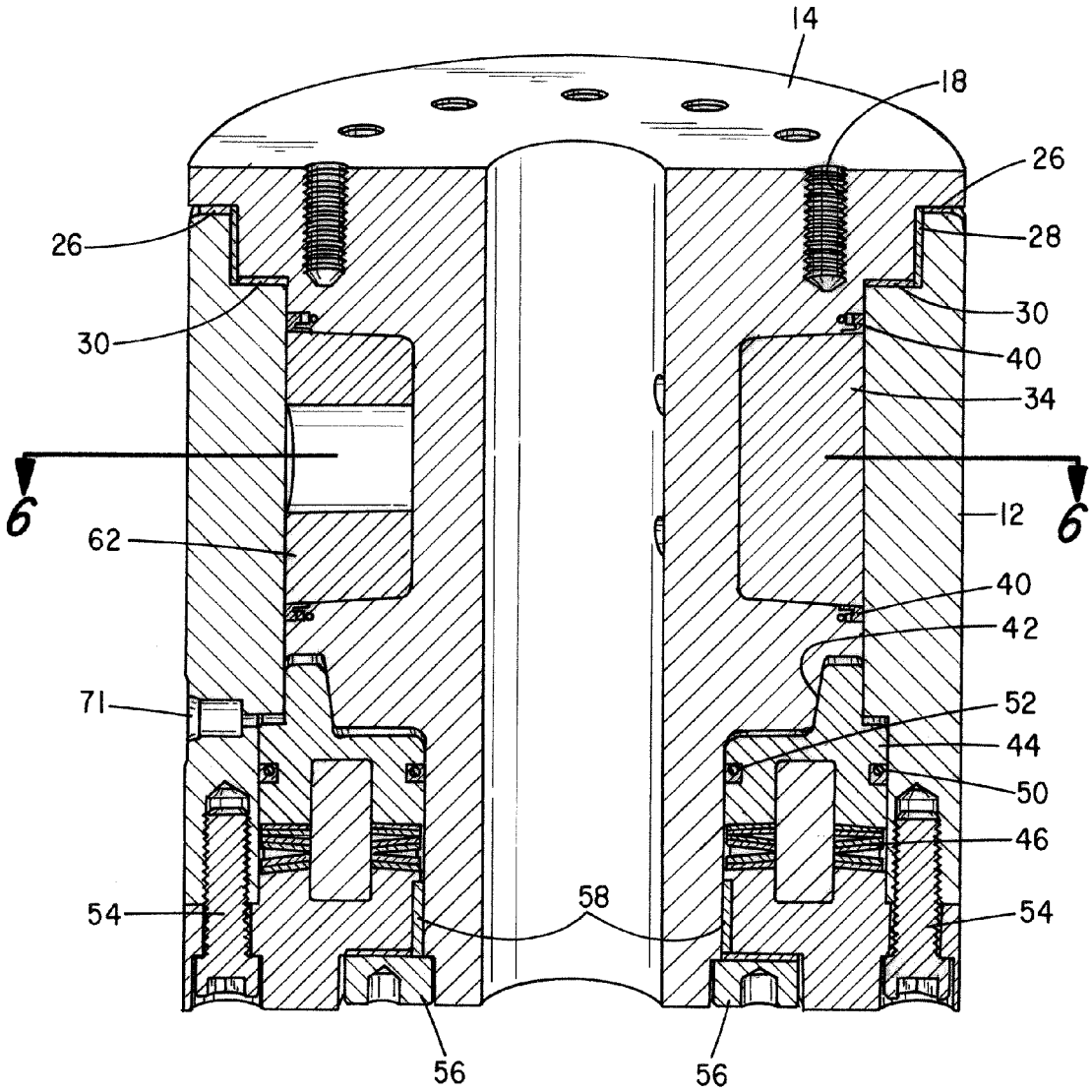
FIG. 5 is a vertical cross-section taken along the lines 5-5 in FIG. 1.

As seen in the vertical cross-sectional view of FIG. 5, the annular piston brake 44 rests upon the springs 46 and, thus, is normally biased upward so that the frustoconically shaped surfaces of the spool 14 and the brake piston 44 frictionally engage one another to lock the spool against rotation of the spool 14 relative to the housing 12.

With continued reference to FIG. 5, it will be note that a hydraulic fluid inlet port 71 extends through the housing wall and leads to a gap or space above the top surfaces of the annular brake piston 44. Hence, when hydraulic fluid under a predetermined high pressure is forced through the inlet port 71, it will act upon the exposed upper surfaces of the piston brake, forcing it downward against the counterforce afforded by the springs 46. With the springs thereby compressed, the frustoconical surfaces of the spool and brake piston no longer engage one another and the spool can be made to rotate relative to the stationary housing 12. However, when the hydraulic fluid pressure at the port 71 is relieved, the springs 46 again urge the brake piston upward to again lock the spool relative to the housing. Thus, upon an intended or unintended loss of hydraulic pressure, the brake is applied to prevent rotation. Also evident in FIG. 5 are the radial seals 40 and 42 that prevent leakage from the vane cavity to exterior parts of the actuator.

Figure 6:
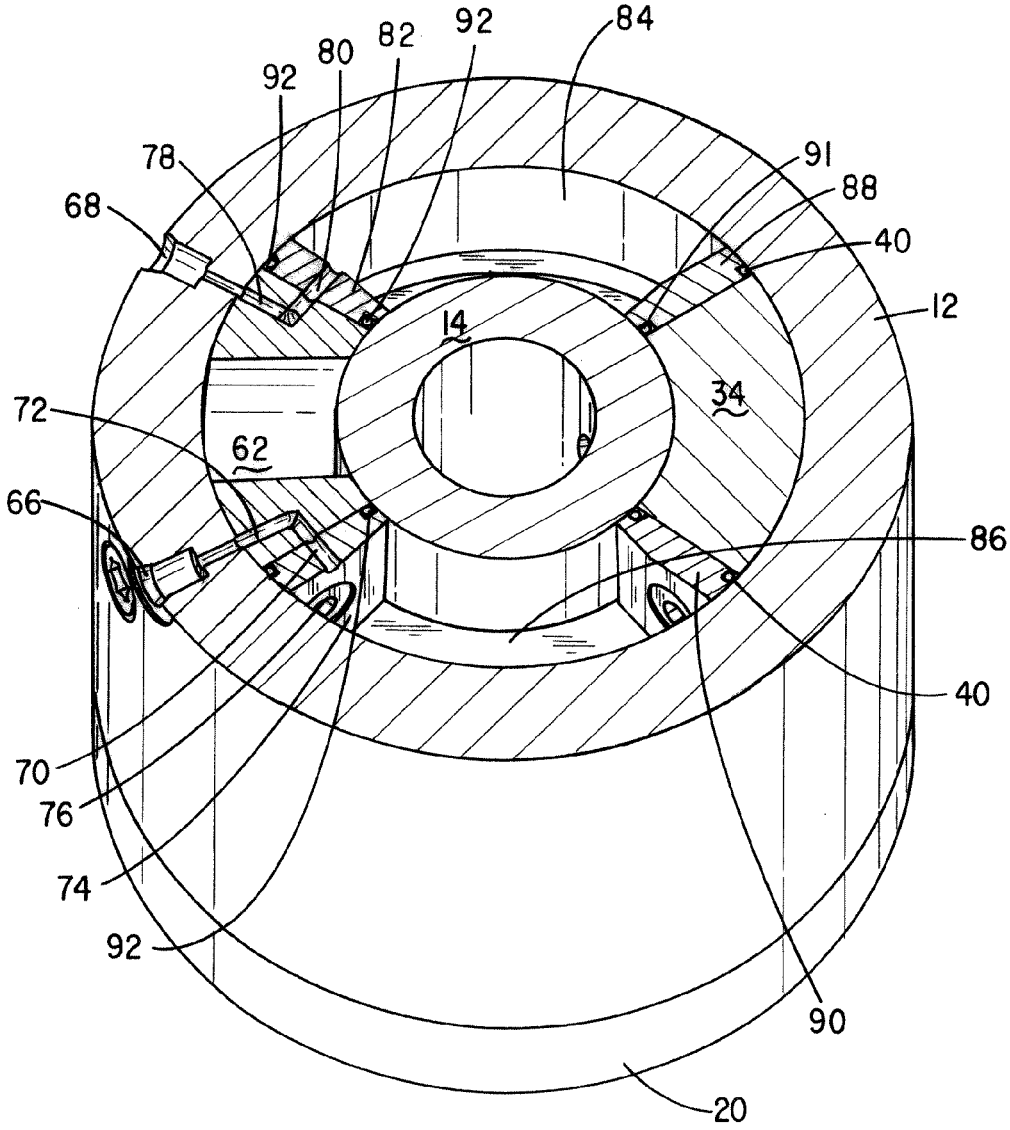
FIG. 6 is a perspective, cross-sectioned view taken the line 6-6 in FIG. 5.

FIG. 6 shows a perspective, cross-sectioned view taken along the line 6-6 in FIG. 5. In this view, it can be seen that the inlet/outlet port 66 through the housing 12 leads to a passageway 72 formed in the stop member and out the port 70 formed through a faceplate 74 that is affixed to the stop 62 by flathead cap screws, as at 76. Faceplate 74 also retains the end periphery seals (D-ring) from the stop and vane. In a similar fashion, the inlet/outlet port 68 formed in the housing 12 leads to a channel 78 formed near the opposite end surface of the stop 62, and thence through a bore 80 in the stop end plate 82 to a variable chamber 84 formed between the stop 62 and the vane 34. It will be seen that when hydraulic fluid under pressure is injected through the port 68, it will exit the bore 80, filling the chamber 84 and urging the vane in a clockwise direction, when viewed in FIG. 6. However, when the hydraulic fluid, under pressure, is injected into the inlet/outlet port 66, it will exit the bore 70 to fill the chamber 86 to force the vane 34 in a counterclockwise direction until the vane 34 hits the stop 62. As the vane 34 moves in the counterclockwise direction, it will bleed the hydraulic fluid back through the bore 80, the passage 78 and the inlet/outlet port 68, returning the hydraulic fluid to nominal tank pressure.

Thus, when it is desired to rotate the spool 14 relative to the housing 12 and thereby swing a load (not shown) relative to a stationary frame (also not shown), hydraulic fluid pressure is first used to disengage the braking mechanism in the manner already described and to rotate the spool to a desired angular position within the housing. As soon as the hydraulic pressure is relieved, the springs 46 function to re-engage the brake piston with the spool to lock the spool at its set position.

To prevent unwanted leakage through the interface between the spool 14 and the stop 62, as well as between the stop 62 and the housing 12 to which it is fastened, an elastomeric D-ring 91 is interposed in the grooves 92, as seen in FIGS. 3 and 6.

It can be seen, then, that there is provided by the present invention a rotary actuator having a fail-safe locking feature that precludes rotation of a load relative to a fixed frame whenever hydraulic pressure is not being applied to swing a load relative to its fixed frame. The rotary actuator of the present invention also incorporates unique sealing structures that confine the applied hydraulic fluid to the selected one of the two variable chambers defined between the ends of the vein and the ends of the stop. It will be apparent to those skilled in the art that the invention may be used in a variety of applications as may be appropriate without departing from the scope of the invention herein claimed. Moreover, since particular operating requirements and environments, as also will be apparent to those skilled in the art, the invention is not considered to be limited to the specific embodiment chosen for the purpose of disclosure, and covers all changes and modifications which do not constitute departures from the true spirit and scope of the invention.

The invention claimed is:

1. A rotary actuator comprising:

(a) a housing defining a cylindrical bore;

(b) a spool member rotatably mounted within the cylindrical bore in the housing, (c) a vane attached to the spool member and projecting radially outward therefrom;

(d) a stop member attached to the housing within the bore and projecting radially inward toward the spool member, the stop member having first and second end surfaces circumferentially spaced from one another defining a gap through which the vane is free to travel, the stop member including first and second passageways for hydraulic fluid, each leading from an inlet port to an outlet port where the outlet ports are on respective ones of the first and second end surfaces; and (e) a hydraulically-actuated, spring-biased friction brake mechanism operatively deployed between the housing and the spool member for preventing rotation of the spool member relative to the housing whenever hydraulic fluid pressure is being applied to an inlet port below a predetermined value.

2. The rotary actuator as in claim 1 wherein the brake mechanism comprises a spring-biased piston adapted to cooperate with a mating surface on the spool member to releasably lock the spool member to the housing, the piston overcoming a force of at least one spring thereon to release the lock when a predetermined hydraulic pressure is present in a space between one end surface of the stop member and the vane.

3. The rotary actuator as in claim 1 wherein the housing is adapted to be attached at the end to a stationary frame and the spool member is adapted to be attached at an end opposite the one end to a load.

4. The rotary actuator as in claim 2 wherein the piston is biased by a plurality of springs.

5. The rotary actuator as in claim 1 and farther including a first seal member disposed between the vane and the cylindrical bore in the housing.

6. The rotary actuator as in claim 5 and further including a second seal member disposed between the stop member and the spool member.

7. The rotary actuator as in claim 6 wherein the first and second seal members comprise O-ring seals.

* * * * *